United States Patent [19]

Jordan, Jr.

[11] Patent Number: 4,754,814

[45] Date of Patent: Jul. 5, 1988

[54] WELL PACKER WITH INTERNALLY ADJUSTABLE SHEAR RELEASE MECHANISM

[75] Inventor: Henry J. Jordan, Jr., Huntsville, Tex.

[73] Assignee: Baker Hughes Incorporated, Houston, Tex.

[21] Appl. No.: 60,296

[22] Filed: Jun. 10, 1987

[51] Int. Cl.[4] ..... E21B 23/04; E21B 23/06; E21B 33/129

[52] U.S. Cl. ..... 166/387; 166/120; 166/134

[58] Field of Search ..... 166/120, 134, 182, 119, 166/212, 387

[56] References Cited

U.S. PATENT DOCUMENTS

| | | | |
|---|---|---|---|
| 2,851,108 | 11/1956 | Reed | 166/139 |
| 3,265,132 | 8/1966 | Edwards, Jr. | 166/120 |
| 3,283,820 | 11/1966 | Tansch | 166/120 |
| 4,018,272 | 4/1977 | Brown et al. | 166/119 |
| 4,049,055 | 9/1977 | Brown | 166/120 X |
| 4,216,827 | 8/1980 | Crowe | 166/120 |
| 4,263,969 | 4/1981 | Garner, Jr. | 166/120 |
| 4,393,929 | 7/1983 | Akkerman | 166/120 X |
| 4,565,247 | 1/1986 | Tapp et al. | 166/123 |
| 4,573,537 | 3/1986 | Hirasuna et al. | 166/387 |

*Primary Examiner*—Hoang C. Dang

*Attorney, Agent, or Firm*—Charles D. Gunter, Jr.

[57] ABSTRACT

A well packer as shown having a shear release mechanism located internally within a packer body which allows the shear release value to be easily varied. A lock body and internal piston ring are initially static. An engagement surface on the lock body cooperates with the setting sleeve to lock setting force into the packing elements. A straight upward pull on the packer mandrel, allows the piston and lock body to become dynamic to relax the packing elements and allow the well packer to be retrieved to the well surface.

6 Claims, 3 Drawing Sheets

WELL PACKER WITH INTERNALLY ADJUSTABLE SHEAR RELEASE MECHANISM

BACKGROUND OF THE INVENTION

1. Field of the Invention

Present invention relates to well devices employed in the completion and production of oil and gas wells. More specifically, the present invention relates to a well packer which is retrievably anchored in a subsurface location within a well casing or other well conduit.

2. Description of the Prior Art

Well packers are used to maintain sealing integrity between inner and outer concentric conduits within a well bore. When the packer is "set" or anchored in a subsurface location, gripping members or "slips" and annular resilient packing elements are extended radially to respectively anchor the packer to the casing and to form a pressure-tight seal between the packer body and the surrounding well conduit or casing. A production tubing string connected to the packer conducts well fluids which enter the casing below the packer to the well surface. A variety of well known techniques are employed to set the packer at the desired subsurface location. Manipulation of the tubing string or the application of fluid pressure through the tubing string are examples of two common techniques.

Retrieval of the set packer requires that the radially extended seals and slips be retracted from engagement with the surrounding conduit. Certain of the prior art packers were released from the set position by manipulating the tubing string to cause mechanical components in the packer to sever or shift to a position which permits the slips and seals to retract. Once released, the tubing string and attached packer could be withdrawn from the casing and retrieved to the well surface.

A straight pull release is preferred by many operators. Thus, many prior art packer designs are released by a straight upward pull of the tubing string. Such packers typically employ shear pins or other frangible devices which rupture when a sufficient shearing force is imparted through the tubing string. The shear pins must remain intact while the packer is set in its normal operating position but must be capable of rupturing when a predetermined retrieving force is exerted on the tubing string.

The present invention has as its object the provision of a well packer which is set by the application of fluid pressure through the tubing string and which is released by a straight upward pull on the tubing string.

Another object of the present invention is the provision of a straight pull release mechanism which provides a simple and effective method for varying the shearing force necessary to release the packer.

Another object of the invention is the provision of a straight pull release mechanism which is internal to the packer but which can be easily adjusted to vary the shear value of the release mechanism.

SUMMARY OF THE INVENTION

Well packer of the invention includes at least one tubular mandrel having upper connecting means for connection in a string of well conduit extending to the well surface, an exterior surface, and an internal bore. An annular packing element is carried about the mandrel which is radially expandable under axial compression. A setting sleeve is carried about the mandrel and is axially movable with respect to the packing element for compressing the packing element. The setting sleeve has an interior surface which is spaced-apart from the mandrel exterior surface by an annular space. A piston area is formed on the interior surface of the setting sleeve and occupies a portion of the annular space. The piston area forms a sliding seal with a mandrel exterior surface upon movement of the setting sleeve. A piston ring, located within the annular space, has a stop end at one extent and an opposite sealing end spaced-apart from the piston area of the setting sleeve. The piston area and seal end together form a piston chamber which communicates by means of an internal port with the bore of the mandrel.

Abutment means on the tubular mandrel contact with the piston ring for allowing movement of the piston ring in the direction of the piston area but prevent opposite relative movement. A lock body is located in the annular space which has a locking end at one extent and an opposite end provided with an outer engagement surface. A ratchet means is carried by the setting sleeve and is engageable with the outer engagement surface upon movement of the setting sleeve in the direction of the packing element to lock setting force into the packing element. Shear means initially affix the lock body against axial movement relative to the setting sleeve. The shear means have a preselected shear index whereby sufficient axial force on the mandrel acts to shear the shear means and free the lock body to thereby relax the packing element.

The above as well as additional objects, features, and advantages of the invention will become apparent in the following detailed description.

DESCRIPTION OF THE PREFERRED EMBODIMENT

Figure 1A:
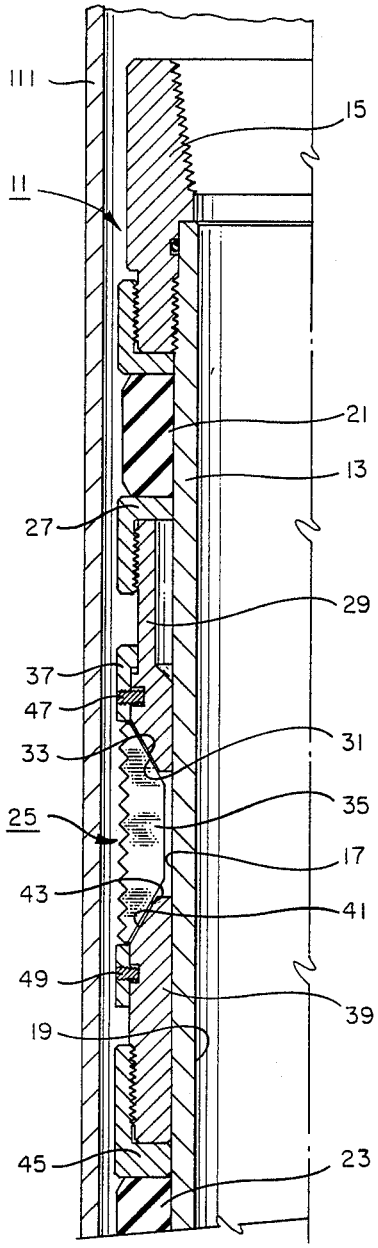
FIG. 1A is a side, cross-sectional view of the upper portion of the well packer of the invention showing the gripping slips and packing element in the relaxed position.

FIG. 1A shows a well packer of the invention designated generally as 11. The well packer is used to maintain sealing integrity between inner and outer concentric conduits within a well bore. The packer 11 includes at least one tubular mandrel 13 having upper connecting means, such as the internally threaded end 15 for connection in a string of well conduit or "tubing" extending to the well surface. It will be understood by those skilled in the art that the invention can be applied as well to a "dual string" packer having two tubular mandrels. The mandrel 13 has an exterior surface 17 and an internal bore 19 which communicates well bore fluids which enter the bore 19 from beneath the packer 11 with the tubing string extending to the well surface. Annular packing elements 21, 23 are carried about the mandrel 13 on either side of a slip gripping mechanism 25. The packing elements 21, 23 are typically resilient elastomeric members which are radially expandable upon axial compression. The upper packing element 21 initially rests upon an expander shoulder 27 which is threadedly connected to an upper cone 29. The upper cone 29 includes an upper tapered surface 31 which contacts the lower expander surface 33 of a gripping slip 35. In the packer of FIG. 1A, there are four gripping slips 35 supported within a slip cage 37 and located at 90 degree spaced circumferential locations about the mandrel 13. A lower cone 39 has an upper tapered surface 41 which contacts the lower tapered surface 43 of each slip 35. The lower cone 39 is threadedly connected to a lower expander shoulder 45. The upper and lower cones are initially restrained from axial movement by means of shear pins 47, 49 in the slip cage 37.

The lower packing element 23 initially rests upon a support shoulder 51 which is threadedly connected to a downwardly extending setting sleeve 53. The setting sleeve 53 is a generally cylindrical member which, as will be explained, is axially movable with respect to the packing elements 21, 23 for compressing the packing elements. The setting sleeve 53 has an interior surface 55 which is spaced-apart from the mandrel exterior surface 17 by an annular space.

Figure 1B:
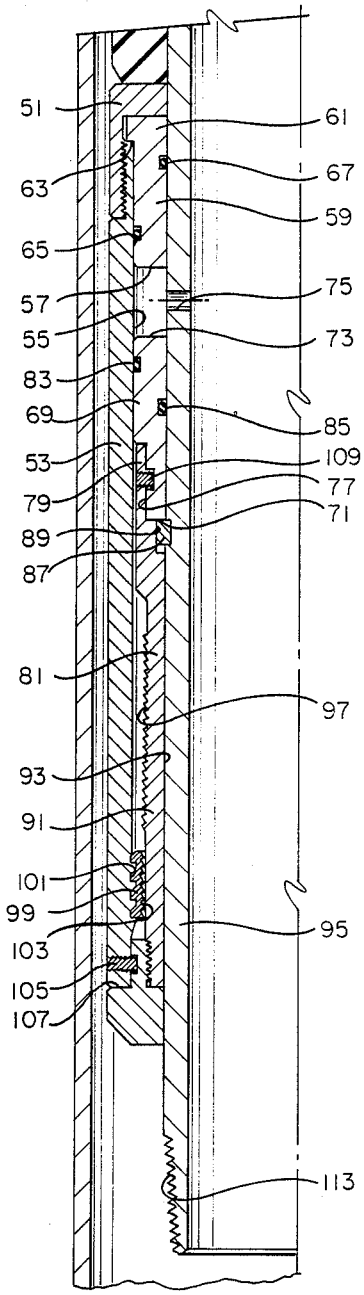
FIG. 1B is a side, cross-sectional view of the lower portion of the well packer of FIG. 1A.

A piston area 57 is formed on the interior surface 55 of the setting sleeve and occupies a portion of the annular space. As shown in FIG. 1B the piston area can be provided as a cylindrical ring 59 having an enlarged upper extent 61 which forms a shoulder 63, the shoulder being engaged by the upper extent of the setting sleeve 53. The ring 59 is provided with O-ring seals 65, 67 for forming a sliding seal with the mandrel exterior surface 17 upon movement of the setting sleeve 53.

A piston ring 69 is located within the annular space below the piston area 57. The piston ring 69 has a stop end 71 at one extent and an opposite sealing end 73 which is spaced-apart from the piston area 57 of the setting sleeve. The piston area 57 and seal end 73 together form a piston chamber which communicates by means of an internal port 75 with the bore 19 of the mandrel 13.

The piston ring 69 includes a region of reduced external diameter 77 which is circumscribed by the upper cylindrical end 79 of a lock body 81. The piston ring 69 also has o-ring seals 83, 85 for forming a sliding seal with the setting sleeve interior and the mandrel exterior.

An abutment, such as snap ring 87 is located on the tubular mandrel 13 within the annular space in contact with the stop end 71 of the piston ring 69 for allowing movement of the piston ring 69 in the direction of the piston area 57 but preventing opposite relative movement. The snap ring 87 is received within a circumferential groove on the mandrel exterior. The snap ring 87 also fits within an undercut area 89 provided in the upper locking end 79 of the lock body 81. The lock body 81 has an opposite generally cylindrical end which has a cylindrical interior 93 which circumscribes the lower extent 95 of the tubular mandrel. The opposite end 91 of the lock body has an outer engagement surface 97. Preferrably, the outer engagement surface 97 comprises tapered or inclined "wicker" teeth. A ratchet means, such as ratchet ring 99 is carried by the setting sleeve 53 on an internal profile 101 and has an internally threaded surface 103 with wicker teeth which are oppositely inclined to the teeth on the surface 97. As a result, the ratchet ring 99 allows upward movement of the setting sleeve 53 in the direction of the packing element 23 but restricts opposite relative movement to thereby lock setting force into the packing element. The setting sleeve 53 is initially held in the position shown in FIG. 1B by means of shear pins 105 which connect the setting sleeve 53 and an external shoulder 107 provided on the lock body end 91.

Shear means, such as shear pins 109 initially affix the locking end 79 of the lock body 81 and the piston ring 69 so that these parts are static. Preferrably, a plurality of shear pins 109 connect the locking end 79 and piston ring 69 at spaced circumferential locations. The shear pins 109 have a preselected shear index whereby sufficient axial force on the mandrel 13 acts through the snap ring 87 to shear the shear means and free the lock body 81 so that the lock body 81 and piston ring 69 become dynamic, as will be explained.

Figure 2A:
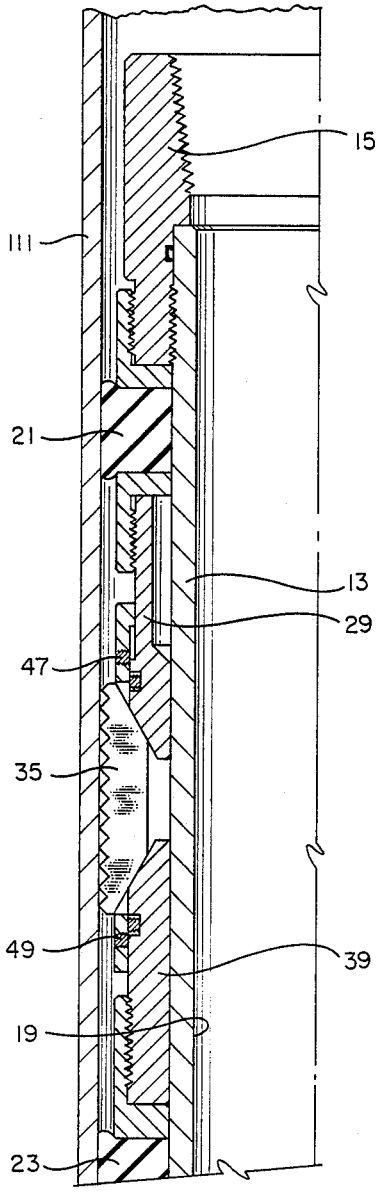
FIG. 2A is a view similar to FIG. 1A but showing the slips and packing element of the well packer in the set position.
Figure 2B:
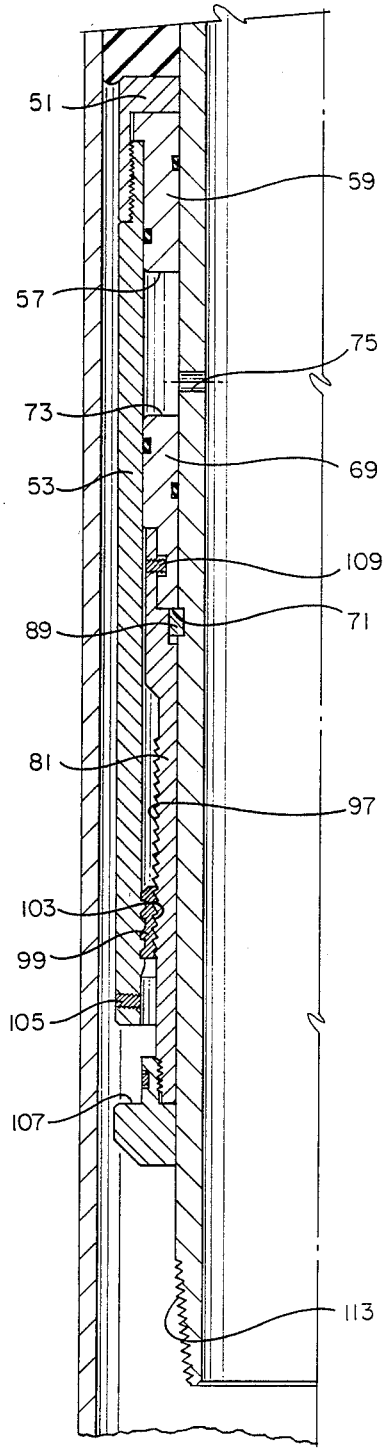
FIG. 2B is a downward continuation of the well packer of FIG. 2A.

The operation of the well packer of the invention will now be described. FIGS. 1A–1B show the well packer in the running-in position. The tubular mandrel upper connecting means 15 would be connected in a well string extended from the well surface to a subterranean location within the surrounding well casing 111. Once the desired well location has been reached, the bore 19 of the mandrel 13 is closed off below the port 75, as by dropping a ball to a ball catching sub connected to the lower threaded extent 113 of the tubular mandrel. Hydraulic pressure is then applied through the bore 19 and through port 75 to the piston chamber. As shown in FIGS. 2A–2B, fluid pressure acts between the piston area 57 and the sealing end 73 causing the shear pins 105 to sever, thereby allowing upward axial travel of the setting sleeve 53. Upward movement of the setting sleeve 53 causes the upper packing element 21 to be expanded radially outward to contact the surrounding casing 111. Continued upward movement of the setting sleeve 53 causes the pins 47, 49, respectively, to shear, thereby allowing outward radial expansion of the gripping slips 35 which grip the surrounding well casing. The continued application of hydraulic pressure through the port 75 results in compression of the lower packing element 23.

As the setting sleeve 53 moves upwardly in the direction of the packing elements, the internal surface 103 of the ratchet ring 99 rides up the engagement surface 97 of the lock body 81. Upon the release of hydraulic pressure within the mandrel bore 19, the ratchet ring 99 locks the setting force within the packing elements 21, 23. It will be appreciated that during the setting operation, the snap ring 89 resists downward movement of the piston ring 69 so that no load is exerted upon the shear pins 109.

Figure 3A:
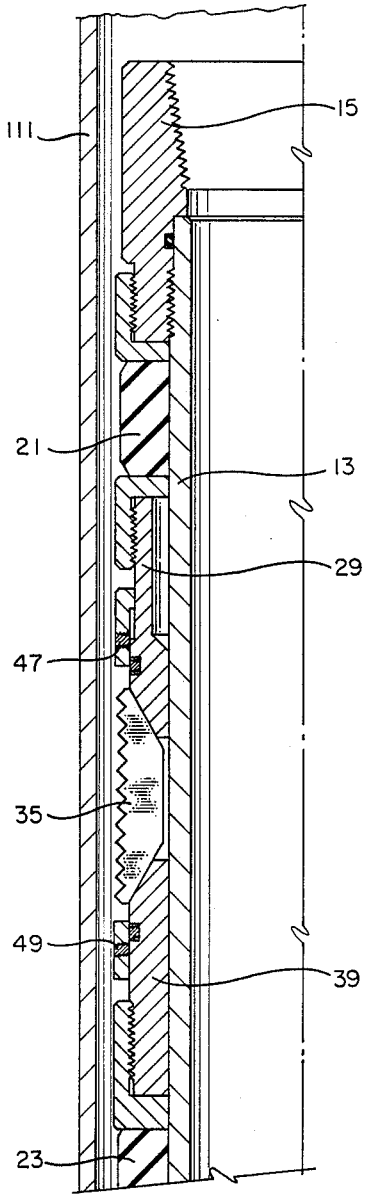
FIG. 3A is a side, cross-sectional view of the well packer of FIG. 1A in the released position.
Figure 3B:
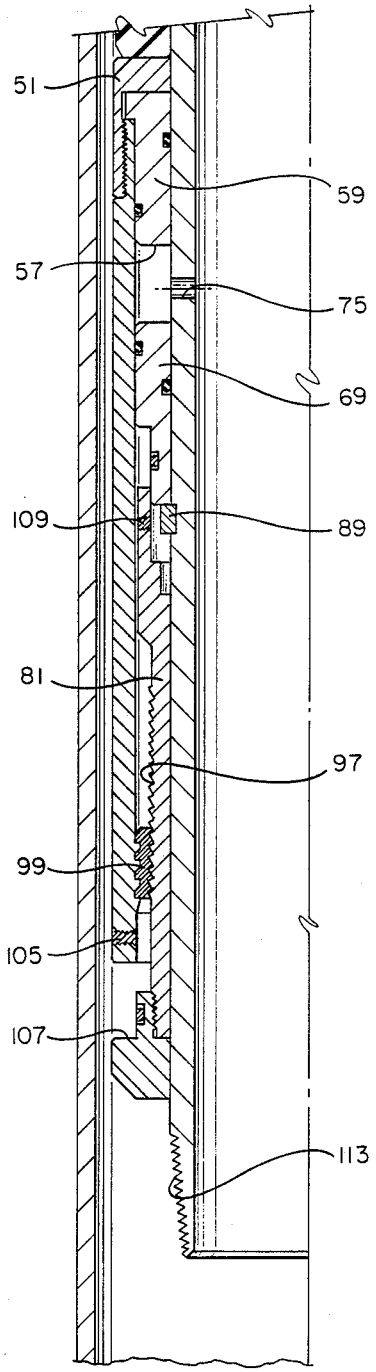
FIG. 3B is a downward continuation of the well packer of FIG. 3A.

To release the well packer, a straight upward pull is exerted through the tubular mandrel 13 by lifting the well string extending to the well surface. Upward force on the mandrel 13 acts through the snap ring 89 upon the stop end 71 of the piston ring 69. Upon the application of a predetermined shearing load, the shear pins 109 are severed, whereby the piston ring 69 and lock body 81 become dynamic, allowing downward relative movement of the setting sleeve 53 and lock body 81 relative to the mandrel 13. Downward movement of the setting sleeve 53 allows the packing elements 21, 23 to relax and allows radial inward movement of the slips 35. The well packer can then be retrieved to the well surface, as shown in FIGS. 3A–3B.

An invention has been provided with several advantages. The well packer of the invention can be hydraulically set and can be released by a straight pull through the tubing string. The piston-lock body arrangement provides a simple and effective mechanism for locking the setting force into the packing elements and allows the shear release value to be conveniently adjusted for varying well conditions.

While the invention has been shown in only one of its forms, it is not thus limited but is susceptible to various changes and modifications without departing from the spirit thereof.

I claim:

1. A well packer of the type used to maintain sealing integrity between inner and outer concentric conduits within a well bore, the packer comprising:

a central mandrel having upper connecting means for connection in a string of well conduit extending to the well surface, an exterior surface, and an internal bore;

an annular packing element carried about the central mandrel which is radially expandable under axial compression;

a setting sleeve carried about the central mandrel, the setting sleeve being axially movable with respect to the packing element for compressing the packing element, the setting sleeve having an interior surface which is spaced-apart from the central mandrel exterior surface by an annular space;

a movable piston ring located within the annular space and engaging the setting sleeve, the movable piston ring forming a sliding seal with the central mandrel exterior surface upon movement of the setting sleeve;

an initially static piston ring located within the annular space, the initially static piston ring having a seal end spaced-apart from the movable piston ring, the movable piston ring and seal end, together with the interior surface of the setting sleeve and the exterior surface of the central mandrel, forming a piston chamber which communicates by means of an internal port in the central mandrel with the bore of the central mandrel;

abutment means located on the central mandrel in contact with the initially static piston ring for preventing movement of the initially static piston ring in one axial direction;

a lock body located in the annular space, the lock body having a locking end at one extent and having an opposite end provided with an outer engagement surface;

ratchet means carried by the setting sleeve and engageable with the outer engagement surface upon movement of the setting sleeve in the direction of the packing element to lock setting force into the packing element; and shear means for initially affixing the lock body against axial travel with respect to the initially static piston ring, the shear means having a preselected shear index whereby movement of the central mandrel in one axial direction acts through the abutment means to move the initially static piston ring and shear the shear means, thereby freeing the lock body and allowing simultaneous movement of the lock body and setting sleeve in the opposite relative axial direction to thereby relax the packing element.

2. A well packer of the type used to maintain sealing integrity between inner and outer concentric conduits within a well bore, the packer comprising:

at least one central mandrel having upper connecting means for connection in a string of well conduit extending to the well surface, an exterior surface, and an internal bore;

an annular packing element carried about the central mandrel which is radially expandable under axial compression;

a setting sleeve carried about the central mandrel, the setting sleeve being axially movable with respect to the packing element for compressing the packing element, the setting sleeve having an interior surface which is spaced-apart from the central mandrel exterior surface by an annular space;

a movable piston ring located within the annular space and engaging the setting sleeve, the movable piston ring forming a sliding seal with the central mandrel exterior surface upon movement of the setting sleeve;

an initially static piston ring located within the annular space, the initially static piston ring having a stop end at one extent and an opposite seal end spaced-apart from the movable piston ring, the movable piston ring and seal end, together with the interior surface of the setting sleeve and the exterior surface of the central mandrel forming a piston chamber which communicates by means of an internal port in the central mandrel with the bore of the mandrel;

abutment means located on the central mandrel and located within the annular space in contact with the stop end of the intially static piston ring for allowing movement of the initially static piston ring in the direction of the moveable piston ring but preventing opposite relative movement;

a lock body located in the annular space, the lock body having a locking end at one extent and having an opposite end provided with an outer engagement surface;

ratchet means carried by the setting sleeve and engageable with the outer engagement surface upon movement of the setting sleeve in the direction of the packing element to lock setting force into the packing element; and shear means for intially affixing the lock body against axial travel with respect to the initially static piston ring, the shear means having a preselected shear index whereby movement of the central mandrel in one axial direction acts through the abutment means to move the initially static piston ring and shear the shear means, thereby freeing the lock body and allowing simultaneous movement of the lock body and setting sleeve in the opposite relative axial direction to thereby relax the packing element.

3. The well packer of claim 2, wherein the ratchet means is a ratchet ring carried on an internal profile in the setting sleeve, the ratchet ring having an internal ratchet surface with wicker teeth, the lock body outer engagement surface being provided with oppositely inclined wicker teeth which allow movement of the setting sleeve in one direction but restrict opposite relative movement with respect to the lock body.

4. The well packer of claim 2, wherein the abutment means is a snap ring carried in a groove provided on the mandrel exterior surface.

5. The well packer of claim 2, wherein the lock body opposite end terminates in an external shoulder which receives one end of the setting sleeve as the well packer is being run into position within the well bore, the setting sleeve end being initially shear pinned to the external shoulder.

6. A method of operating a well packer of the type used to maintain sealing integrity between inner and outer concentric conduits within a well bore, comprising the steps of:

making up at least one central mandrel having upper connecting means in a string of well conduit extending to the well surface, the central mandrel having an exterior surface, and an internal bore;

providing an annular packing element on the central mandrel between a compression shoulder and a setting sleeve, the setting sleeve being axially movable with respect to the packing element for compressing the packing element, the setting sleeve being provided with an interior surface which is spaced-apart from the central mandrel exterior surface by an annular space;

providing a movable piston ring located within the annular space and engaging the setting sleeve, the movable piston ring forming a sliding seal with the central mandrel exterior surface upon movement of the setting sleeve;

installing an initially static piston ring within the annular space, the initially static piston ring having a seal end spaced-apart from the movable piston ring, the movable piston ring and seal end, together with the interior surface of the setting sleeve and the exterior surface of the central mandrel, forming a piston chamber which communicates by means of an internal port in the central mandrel with the bore of the mandrel;

providing an abutment on the central mandrel in contact with the initially static piston ring, thereby preventing movement of the initially static piston ring in one axial direction;

installing a lock body in the annular space and affixing the lock body by shear means to prevent movement of the lock body relative to the initially static piston ring, whereby the lock body and piston ring are initially static;

providing ratchet means on the interior of the setting sleeve which are engageable with an exterior surface of the lock body upon movement of the setting sleeve, thereby allowing movement in the direction of the packing element but preventing opposite relative movement;

setting the packing element by supplying hydraulic pressure through the internal port which acts against the movable piston ring to move the movable piston ring and attached setting sleeve in the direction of the packing element, the ratchet means serving to lock setting force into the packing element; and thereafter releasing the packer by exerting an upward force on the central mandrel sufficient to shear the shear means and release the lock body while simultaneously moving the initially static piston axially upward, opposite relative movement of the setting sleeve and lock body serving to relax the packing element.

* * * * *